US008745938B2

(12) United States Patent
Schuetz et al.

(10) Patent No.: US 8,745,938 B2
(45) Date of Patent: Jun. 10, 2014

(54) SKYLIGHT WITH IMPROVED LOW ANGLE LIGHT CAPTURE

(71) Applicant: Replex Mirror Company, Mount Vernon, OH (US)

(72) Inventors: Mark A. Schuetz, New Albany, OH (US); Kara A. Shell, New Albany, OH (US)

(73) Assignee: Replex Mirror Company, Mount Vernon, OH (US)

( * ) Notice: Subject to any disclaimer, the term of this patent is extended or adjusted under 35 U.S.C. 154(b) by 0 days.

(21) Appl. No.: 13/853,461

(22) Filed: Mar. 29, 2013

(65) Prior Publication Data

US 2014/0026501 A1 Jan. 30, 2014

Related U.S. Application Data

(60) Provisional application No. 61/676,453, filed on Jul. 27, 2012.

(51) Int. Cl.
*E04B 7/18* (2006.01)

(52) U.S. Cl.
USPC ..... 52/200; 52/745.16

(58) Field of Classification Search
USPC ..... 52/28, 200, 199, 745.16
See application file for complete search history.

(56) References Cited

U.S. PATENT DOCUMENTS 3,350,819 A 11/1967 Polidoro et al.
4,339,900 A * 7/1982 Freeman ..... 52/200
4,561,424 A 12/1985 Gill et al.
4,814,828 A * 3/1989 Noble ..... 355/37
5,099,622 A 3/1992 Sutton
5,493,824 A 2/1996 Webster et al.
5,502,935 A 4/1996 Demmer
5,528,471 A 6/1996 Green
5,596,848 A * 1/1997 Lynch ..... 52/200
5,655,339 A * 8/1997 DeBlock et al. ..... 52/200
5,896,712 A 4/1999 Chao
5,983,581 A 11/1999 DeBlock et al.
6,178,707 B1 1/2001 Bengtson
6,195,949 B1 3/2001 Schuyler
6,363,667 B2 4/2002 O'Neill
6,604,329 B2 8/2003 Hoy et al.
6,801,361 B2 10/2004 Aoki et al.
6,813,864 B2 * 11/2004 Landis ..... 52/200
6,966,157 B1 11/2005 Sandow
7,057,821 B2 6/2006 Zincone
7,395,636 B2 7/2008 Blomberg
7,430,077 B2 9/2008 Brice et al.

(Continued)

*Primary Examiner* — Robert Canfield
*Assistant Examiner* — Babajide Demuren
(74) *Attorney, Agent, or Firm* — Frank H. Foster; Kremblas & Foster

(57) ABSTRACT

A skylight with a light transmission passage bounded by reflective surface. Centrally facing, curved mirror reflective surfaces are positioned on opposite sides of the passage. The curved reflective surfaces have a curvature slope that becomes progressively greater, with respect to a plane that is perpendicular to the axis, as the surfaces progress from the upper end to the lower end of the passage. The curved mirror surfaces are also curved inward at their upper end. Preferably, the curved mirror surfaces are parabolic and most preferably are formed as a compound parabolic concentrator that is mounted in an inverted orientation. The skylight of the invention also has reflective surfaces that are orthogonal to these reflective surfaces. The orthogonal reflective surfaces can alternatively be either formed with the same curvature and orientation or can be planar.

36 Claims, 7 Drawing Sheets

(56) References Cited

U.S. PATENT DOCUMENTS

| | | | | |
|---|---|---|---|---|
| 7,546,709 | B2 | 6/2009 | Jaster et al. | |
| 7,631,464 | B2 | 12/2009 | Valentz et al. | |
| 7,639,423 | B2 | 12/2009 | Kinney et al. | |
| 7,736,014 | B2 | 6/2010 | Blomberg | |
| 7,757,444 | B1 | 7/2010 | Halliday | |
| 7,954,281 | B2 | 6/2011 | Jaster | |
| 7,957,065 | B2 | 6/2011 | Jaster | |
| 7,976,189 | B2 | 7/2011 | Osborn | |
| 2001/0013207 | A1* | 8/2001 | O'Neill | 52/200 |
| 2004/0066645 | A1 | 4/2004 | Graf et al. | |
| 2009/0284970 | A1* | 11/2009 | Graf et al. | 362/247 |
| 2009/0293386 | A1* | 12/2009 | O'Hagin | 52/200 |
| 2010/0309556 | A1 | 12/2010 | Jaster | |
| 2011/0289870 | A1* | 12/2011 | Nemazi et al. | 52/200 |
| 2012/0272593 | A1* | 11/2012 | O'Neill et al. | 52/200 |

* cited by examiner

Fig. 1
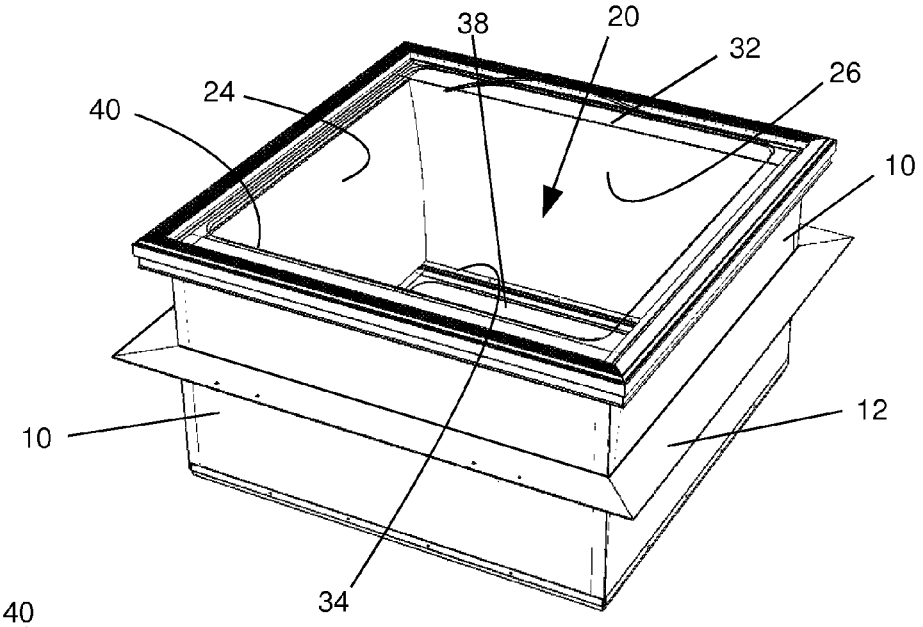
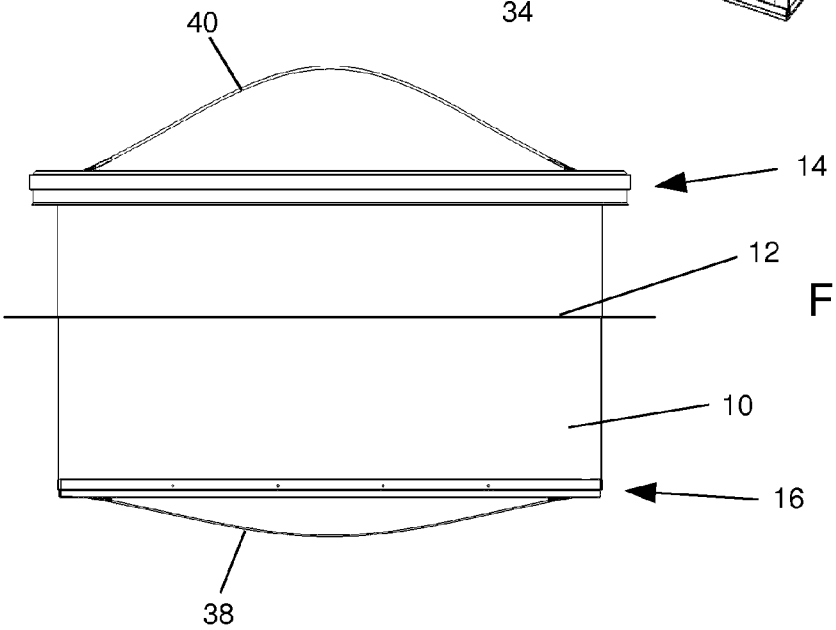
Fig. 2
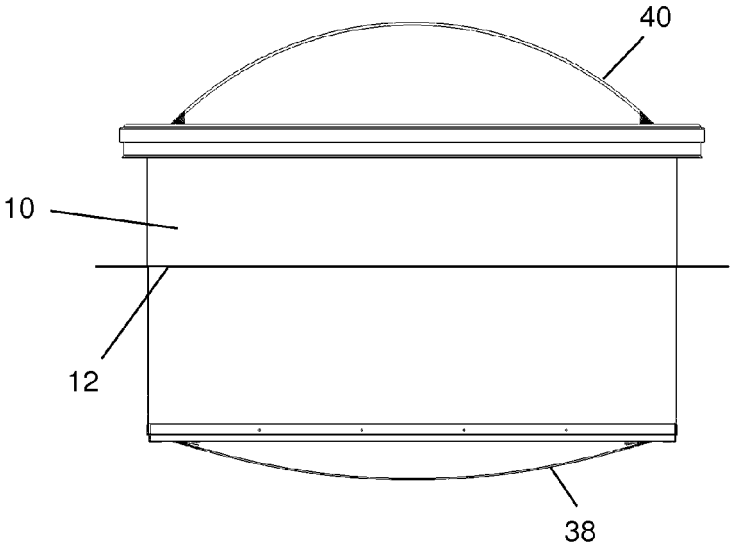
Fig. 3

Fig. 9
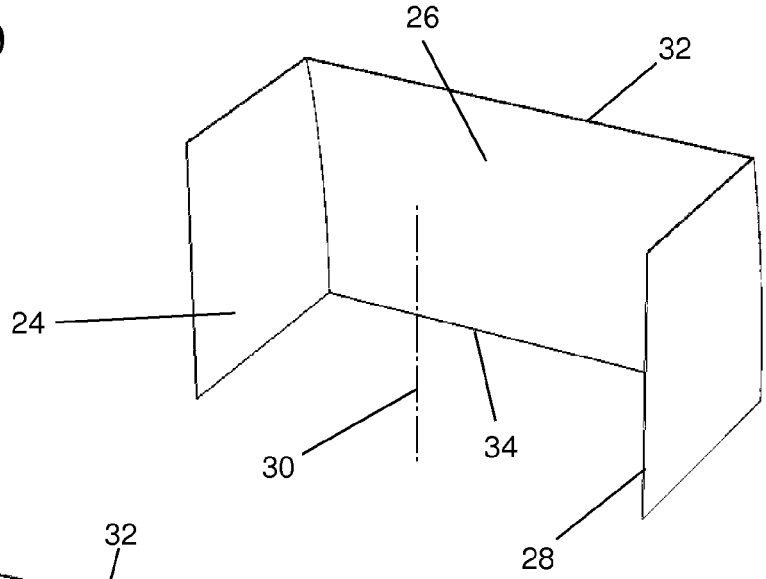
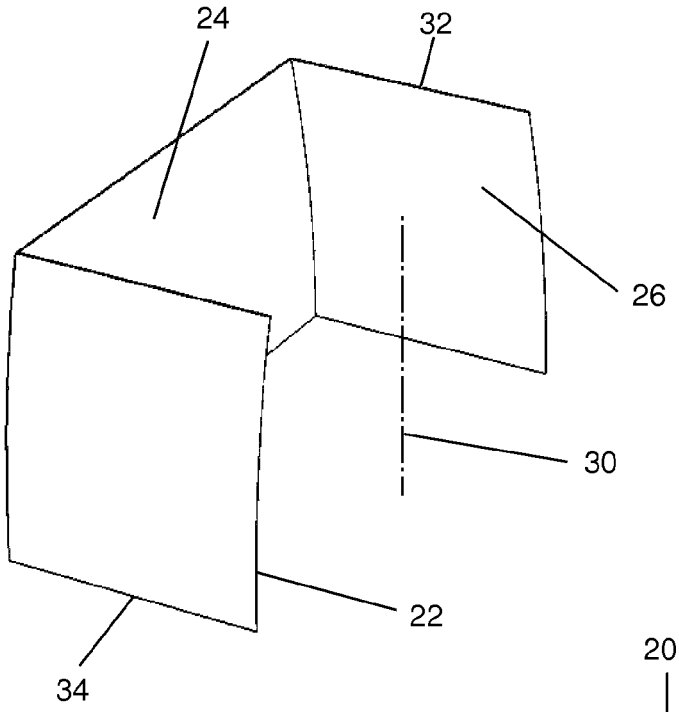
Fig. 10
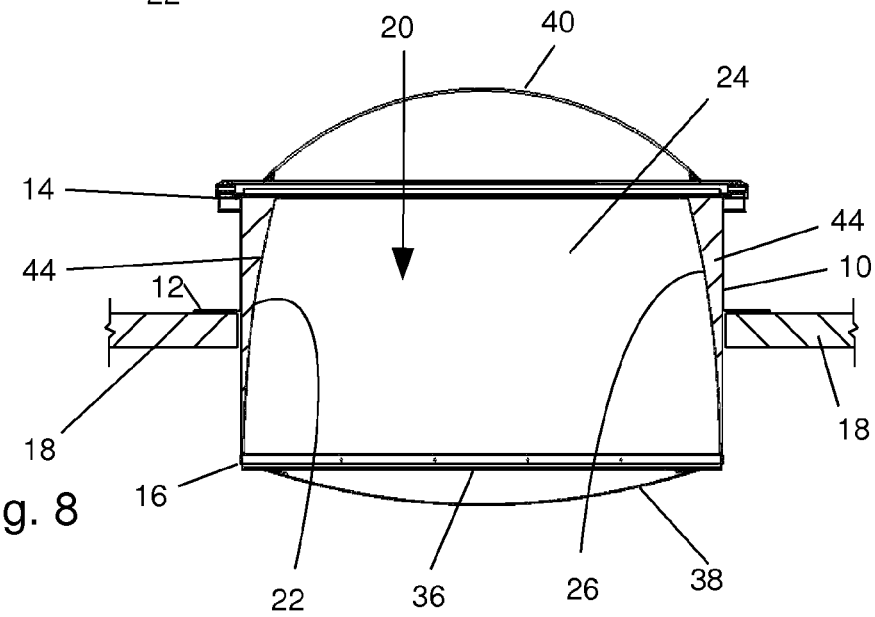
Fig. 8

Fig. 11
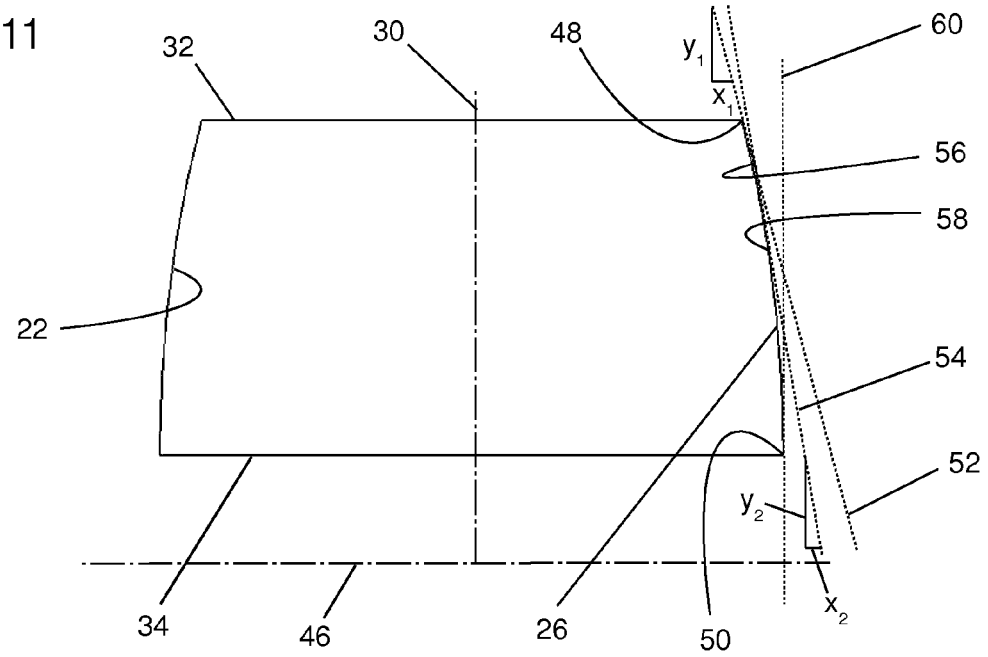
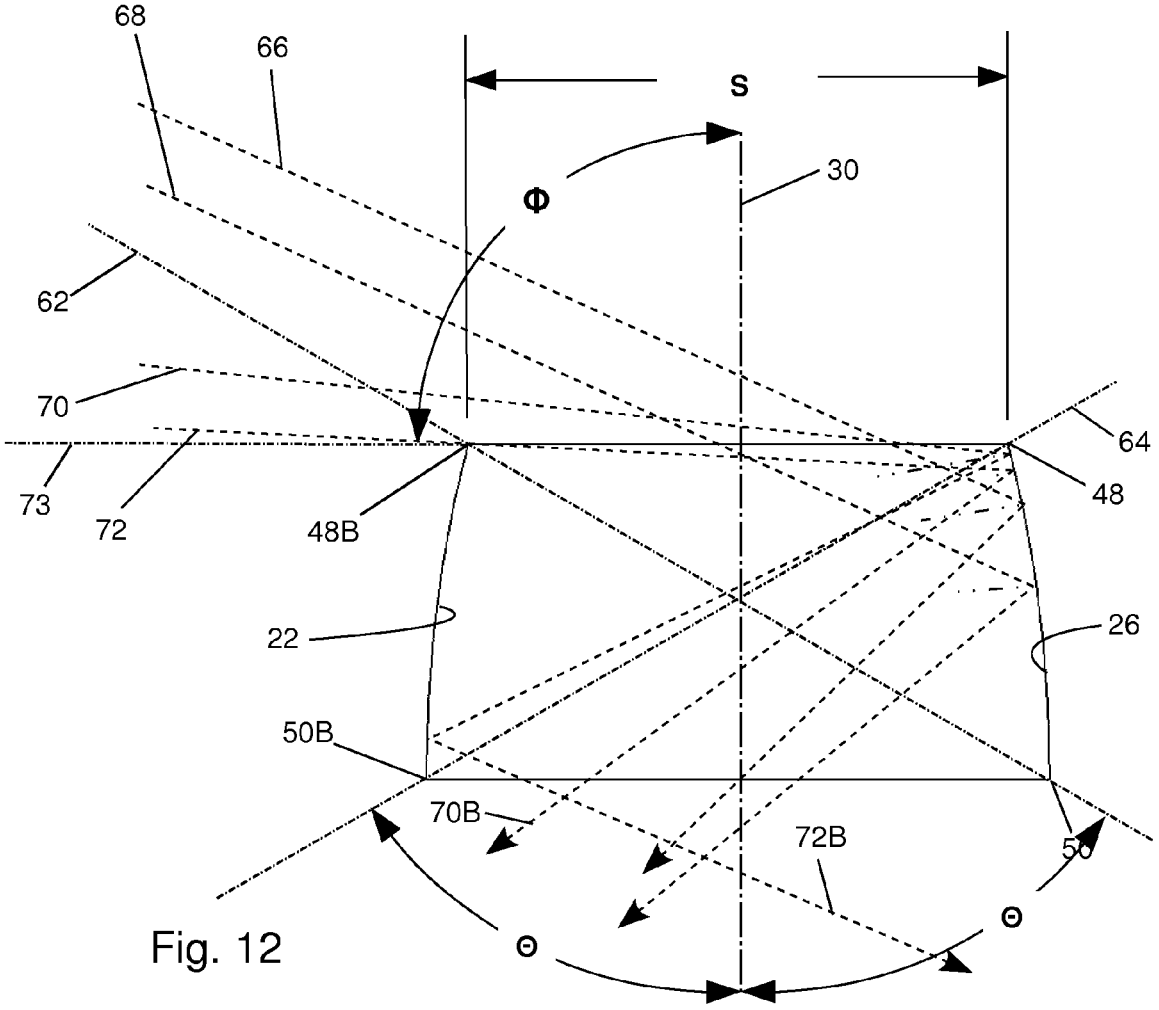
Fig. 12

Fig. 13
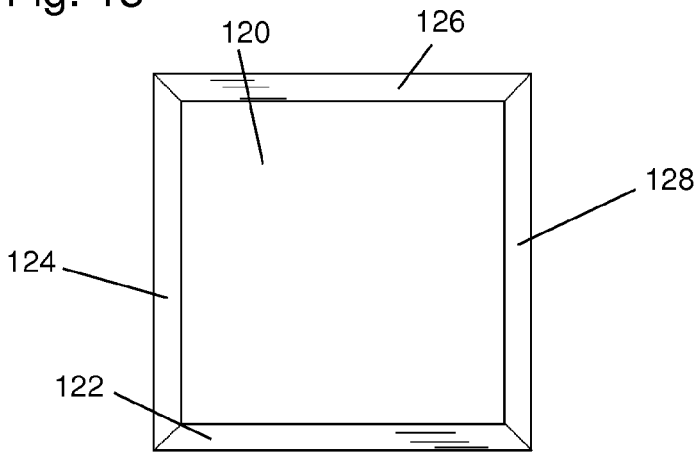
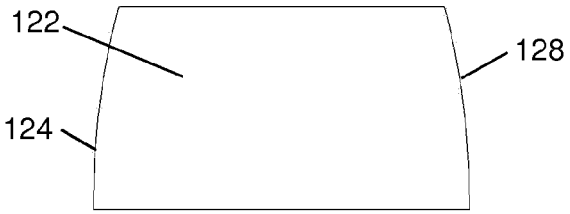
Fig. 14
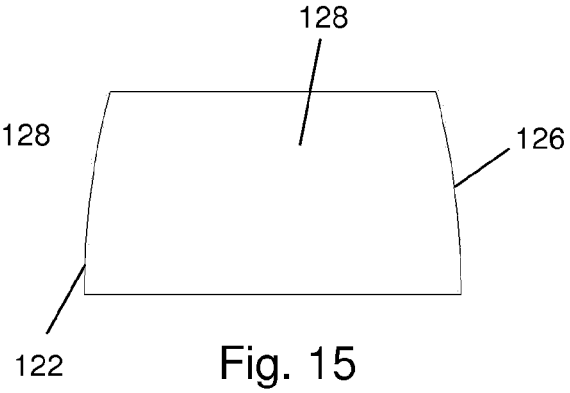
Fig. 15
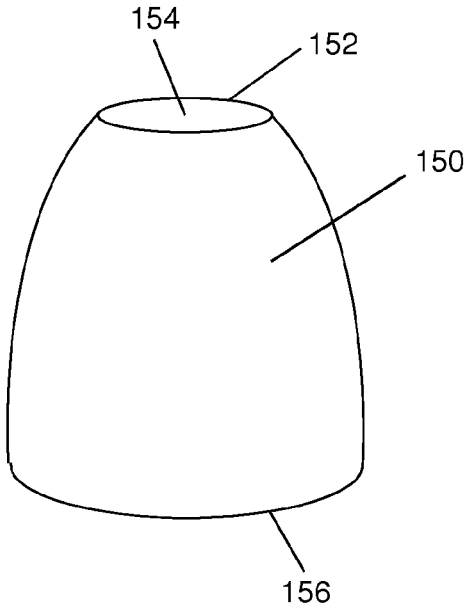
Fig. 16
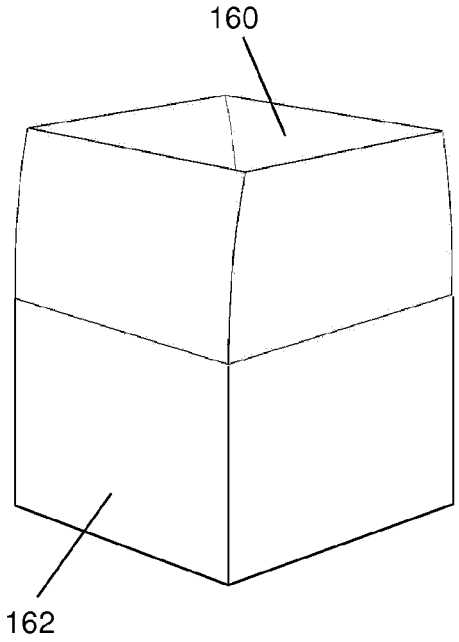
Fig. 17

SKYLIGHT WITH IMPROVED LOW ANGLE LIGHT CAPTURE

CROSS-REFERENCES TO RELATED APPLICATIONS

This application claims the benefit of U.S. Provisional Application No. 61/676,453 filed Jul. 27, 2012. The above claimed provisional priority application, is hereby incorporated in this application by reference.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

This invention relates generally to devices for efficiently transmitting light and more particularly relates to skylights for transmitting light from the sun through a roof to a room below the roof for assisting in illuminating the room with natural sunlight and for doing so in a manner that (1) maximizes the capture efficiency, which is the proportion of the light incident upon the skylight that is transmitted into the room, (2) transmits the sunlight into the room as pleasingly diffuse light and (3) protects the inhabitants of the room from UV light.

For centuries, various kinds of skylights have been recognized as desirable features of inhabited buildings. Before the existence of modern lighting, their use was principally for the utilitarian purpose of enhancing visibility within a building interior. Today, even with modern lighting, skylights not only reduce the need for artificial light and the energy they consume but also they provide the better visibility that results from bright, broad spectrum sunlight. Skylights also bring psychologically beneficial warmth into the environment as a result of the presence of natural sunlight.

The types of skylights that are currently available range from a relatively large simple skylight, that is essentially a window constructed through a roof, to a small tubular skylight or light tunnel that is essentially a tube lined with a reflective material intended to channel the sun's rays down into a room. Unfortunately, skylights also have some inherent, undesirable characteristics that require that choices and compromises be made between the desirable and the undesirable characteristics. For example, the larger a designer makes the cross-sectional area of the sunlight transmitting path into the room, the more sunlight that is captured and transmitted into the room but also the larger becomes the heat loss in winter and heat gain in summer. Similarly, the larger the skylight, the more difficult it becomes to provide sufficient roof support for the skylight and avoid water and air leaks. The tubular skylights provide an alternative with a considerably smaller footprint area to minimize those problems but, because of the relatively small area of their upper opening, their light capture is limited. Consequently, it can be appreciated that any improvement to a skylight that increases the sunlight transmitted into the room without increasing the area of the opening or cross-sectional area of the light transmission path would improve the desirable characteristics without degrading the skylight by increasing the undesirable characteristics.

One characteristic of skylights that can benefit from improvement is the sunlight capture efficiency for a low angle sun. Preferably, that capture efficiency would be improved without requiring any moving parts, which add considerable cost, and without enlarging the area of the skylight. Capture efficiency is the ratio of the light that is transmitted through the skylight and out of the lower open end of the light passage to the light incident upon the upper open end of the light passage. The quantity of incoming light and exiting light may be expressed in terms of radiant energy or luminous energy and their ratio multiplied by 100 to be expressed in percentage.

The angle of the sun is known as the sun's altitude which is the angle from the horizon to a line extending from a point on earth to the center of the sun. For any sun altitude that is greater than 0° and less than 90°, a portion of the sunlight is incident upon surfaces that form a boundary around the light transmission passage through the skylight. These boundary surfaces may be painted surfaces of surrounding frames that are common on conventional skylights or they may be reflective, including specularly reflective, surfaces that have been used for light tunnels. Because these boundary surfaces have a finite height, the sun must have an altitude above an angle, defined herein as an acceptance altitude, in order for some of the sun's rays to pass directly through the light transmission passage of the skylight without being incident upon a surface that bounds the light passage. Consequently, for any sun altitude greater than the acceptance altitude and less than 90°, a portion of the sunlight is incident upon at least one boundary surface and a portion is transmitted through the skylight without being incident upon a boundary surface of the light transmission passage. Furthermore, as the sun's altitude becomes less, the ratio of sunlight incident upon the boundary surfaces to the sunlight transmitted directly through the light transmission passage increases. For a sun altitude that is less than the acceptance altitude, all sunlight that is incident upon the upper end of the light transmission passage is incident only upon one or more boundary surfaces of the light transmission passage; that is, no sunlight is transmitted directly through the light transmission passage without reflection.

The principal purpose and feature of the present invention is to increase the sunlight capture efficiency for skylights of several types by increasing the quantity of light that exits from the skylight into the room after being incident upon the boundary surfaces of the light passage through the skylight.

Additionally, it is a purpose and feature of the present invention to particularly increase the quantity of light that exits from the skylight into the room after being incident upon the boundary surfaces from a low angle, small altitude sun, including especially from a sun that is at or below the acceptance altitude and most especially from a sun altitude that is only a few degrees above the horizon.

A further purpose and feature of the present invention is provide a skylight for which the sunlight, that is reflected from a reflecting boundary surface of the light transmission passage, is not collimated or focused but rather is highly scattered and diffused so that it does not create glare and hot spots that are unpleasant for inhabitants in a room below the skylight.

It is also an object of the present invention to provide a skylight that is relatively inexpensive and light weight and yet has structural rigidity, is easily installed, provides a high thermal insulation barrier and can provide protection against UV radiation.

BRIEF SUMMARY OF THE INVENTION

The skylight of the invention has a light transmission passage bounded by reflective surfaces and a central axis along the passage. The passage has an upper end for opening upward when the skylight is in its installed operable orientation and a lower end for opening in a downward direction in its operable orientation. Centrally facing, curved mirror reflective surfaces are positioned on opposite sides of the passage. These curved reflective surfaces have a curvature slope that becomes progressively greater, with respect to a plane that is perpendicular to the axis, as the surfaces progress from the upper end to the lower end. The curved mirror surfaces are oriented with their reflective surfaces curved inward toward the axis at the upper end. Preferably, the curved mirror surfaces are parabolic and most preferably are formed as a compound parabolic concentrator that is mounted in an inverted orientation. The skylight of the invention also has reflective surfaces that are orthogonal to these reflective surfaces. The orthogonal reflective surfaces can alternatively be either formed with the same curvature and relative orientation or they can be planar.

BRIEF DESCRIPTION OF THE SEVERAL VIEWS OF THE DRAWINGS

FIG. 1 is a view in perspective of the preferred embodiment of the invention.

FIG. 2 is a view in front elevation of the embodiment illustrated in FIG. 1.

FIG. 3 is a view in side elevation of the embodiment illustrated in FIG. 1.

FIG. 8 is a view in vertical section of the embodiment illustrated in FIG. 1 installed on a roof and taken substantially along the line 6-6 of FIG. 4.

FIG. 9 is a view in vertical section and in perspective of reflective mirror components of the embodiment illustrated in FIG. 1 and taken substantially along the line 5-5 of FIG. 4.

FIG. 10 is a view in vertical section and in perspective of reflective mirror components of the embodiment illustrated in FIG. 1 and taken substantially along the line 6-6 of FIG. 4.

FIG. 11 is a diagram of reflective mirror components of the embodiment illustrated in FIG. 1 illustrating the curvature slope of reflective mirror surfaces, the axis of the light transmission passage through the skylight and a plane that is perpendicular to the axis and is preferably horizontal when the embodiment is installed in its operable orientation.

FIG. 12 is a diagram of reflective mirror components of the embodiment illustrated in FIG. 1 illustrating parameters of the invention and the reflection of solar light rays through the light transmission passage of the invention.

FIG. 13 is a top plan view of an alternative embodiment of the invention.

FIG. 14 is a view in front elevation of the embodiment illustrated in FIG. 13.

FIG. 15 is a view in side elevation of the embodiment illustrated in FIG. 13.

FIG. 16 is a view in perspective of another alternative embodiment of the invention.

FIG. 17 is a view in perspective of yet another alternative embodiment of the invention.

Figure 4:
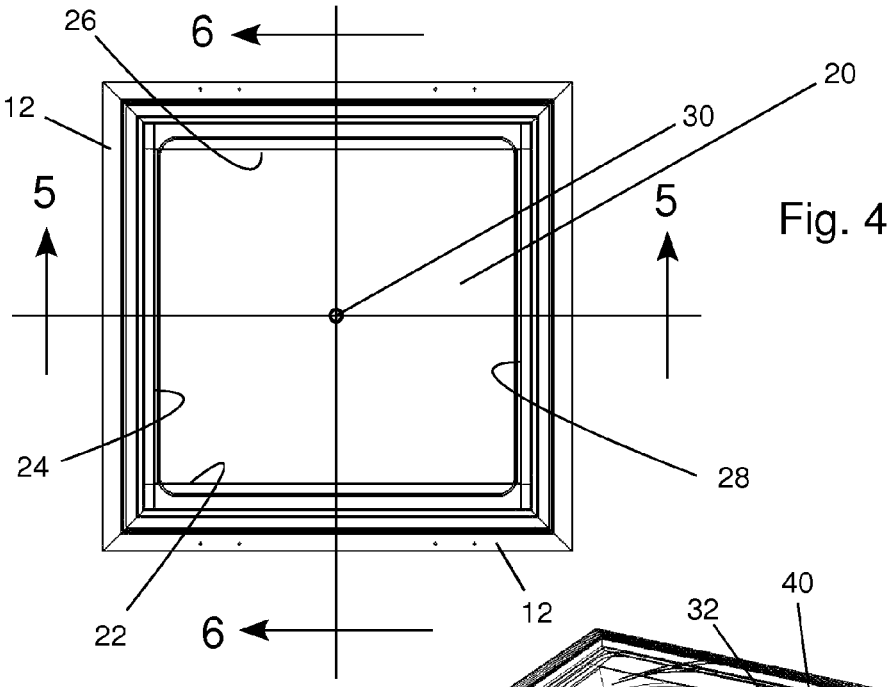
FIG. 4 is a top plan view of the embodiment illustrated in FIG. 1.
Figure 5:
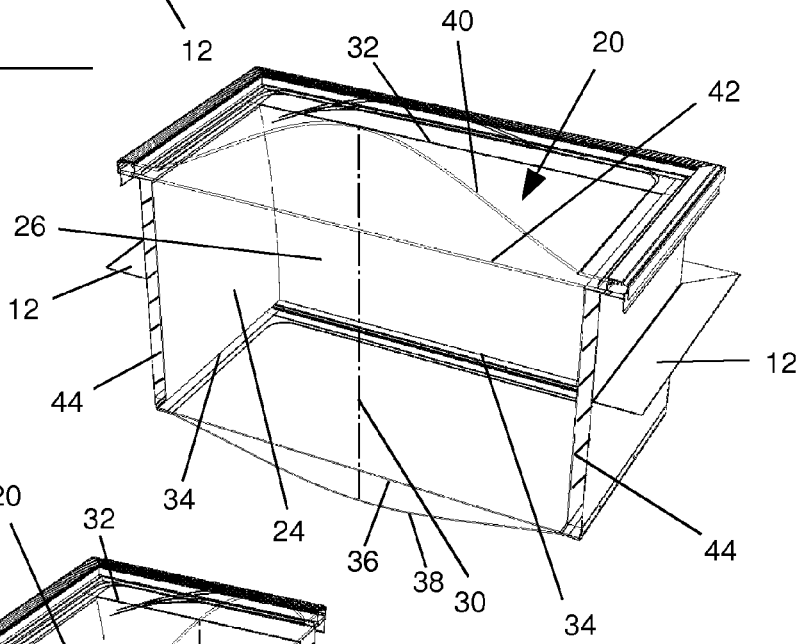
FIG. 5 is a view in vertical section and in perspective of the embodiment illustrated in FIG. 1 and taken substantially along the line 5-5 of FIG. 4.
Figure 6:
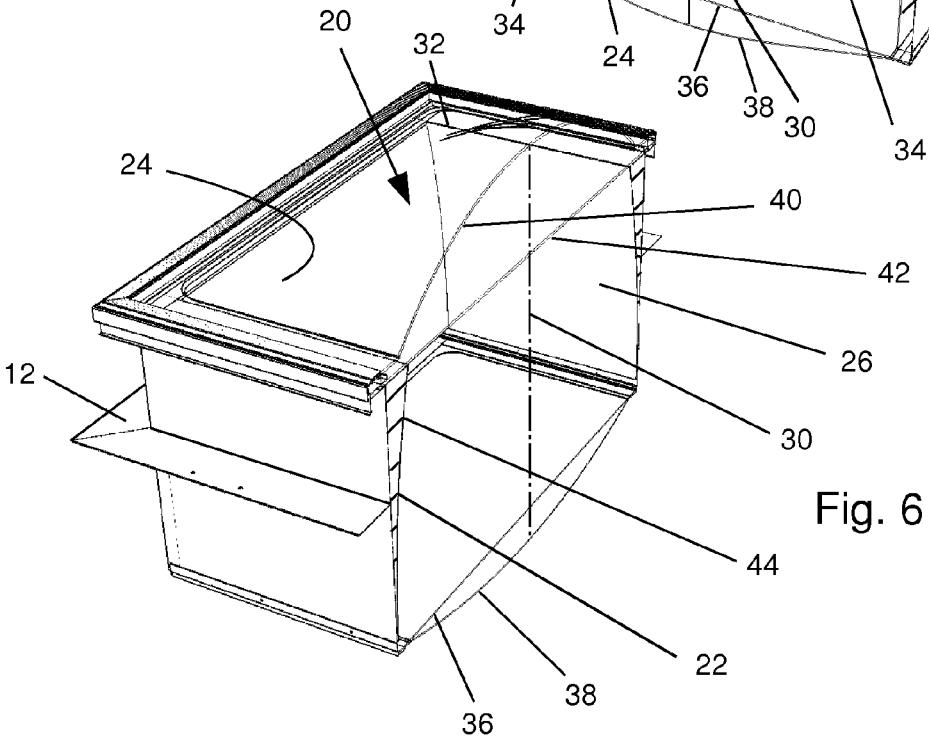
FIG. 6 is a view in vertical section and in perspective of the embodiment illustrated in FIG. 1 and taken substantially along the line 6-6 of FIG. 4.
Figure 7:
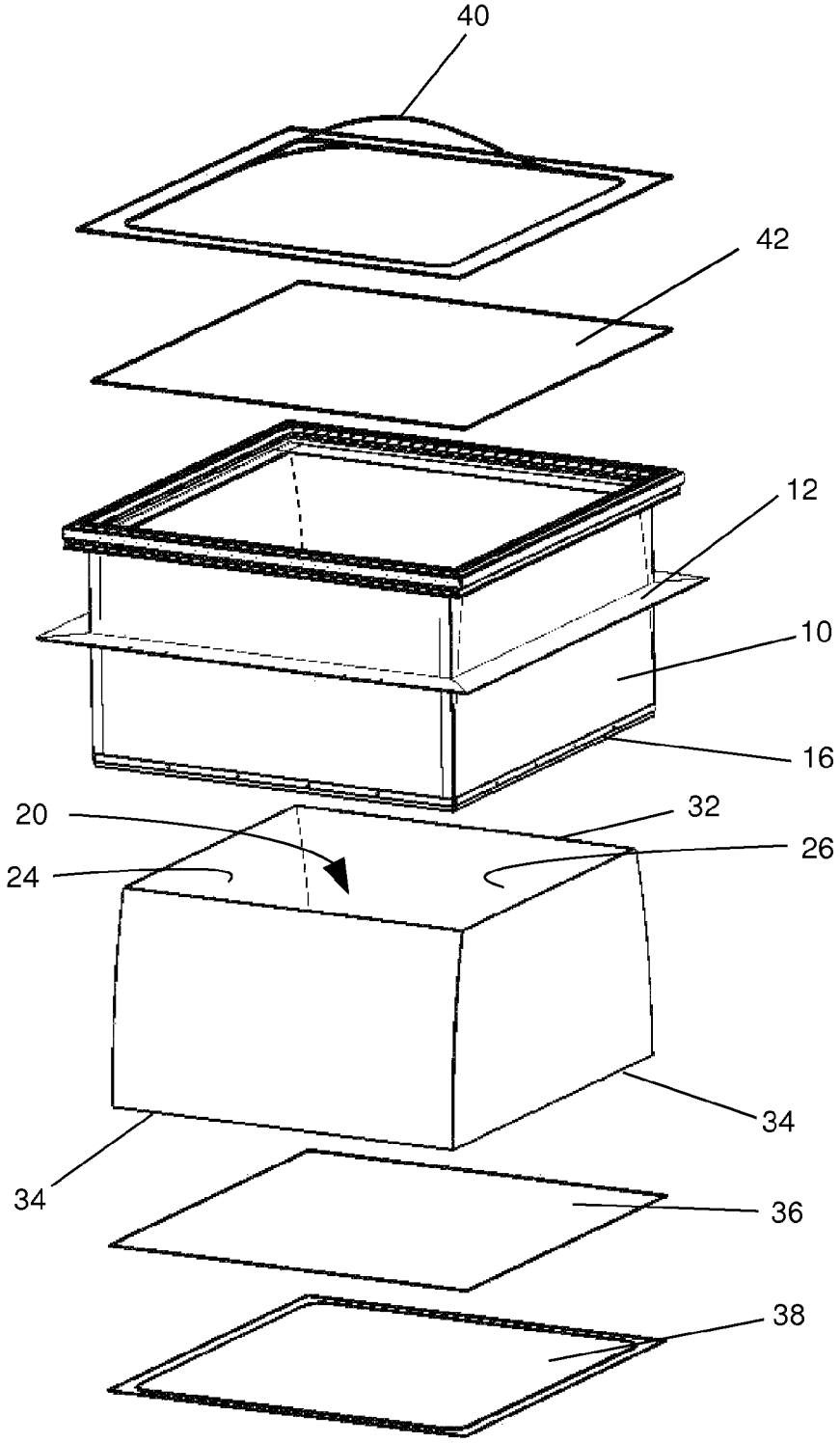
FIG. 7 is an exploded view of the embodiment illustrated in FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

U.S. Provisional Application No. 61/676,453 filed Jul. 27, 2012, the above claimed priority application, is incorporated in this application by reference.

As will be seen from the following description, the main feature of a skylight constructed according to the invention is that it uses mirror reflective surfaces at the boundaries of the skylight's light transmission passage that have a contour and orientation which reduce the number of reflections of incoming solar rays within the light transmission passage before the rays exit the skylight into the room. Because every reflection results in a portion of the incident light being absorbed by the reflective surface and a portion being reflected, reducing the number of reflections reduces the total absorption of light and consequently increases the sunlight capture efficiency. With skylights that embody the present invention, the increase in sunlight capture efficiency is especially effective for a low altitude sun, such as present immediately after sunrise and immediately before sunset.

The entire assembly of the preferred embodiment of the invention is illustrated in FIGS. 1 through 8. Referring to those figures, the illustrated skylight has an outer shell or casing 10 with four surrounding sidewalls and is preferably formed of sheet aluminum or steel. A roof mounting flange 12 is interposed between the top edge 14 and bottom edge 16 of the casing 10 and extends outward around the entire periphery of the casing 10. The skylight is attached to a roof 18 (FIG. 8) by nails, screws or other fasteners through the flange 12 into the roof 18 and the upper portion of the casing 10 sidewalls above the flange 12 function as the roof curb of the skylight.

The skylight has a central light transmission passage 20 bounded by (and therefore defined by) reflective surfaces 22, 24, 26 and 28. The contour and orientation of these reflective surfaces 22, 24, 26 and 28 will be described in more detail following a description of the remaining components of the preferred skylight. A central axis 30 extends along the passage 20 and ordinarily is vertically oriented when the skylight is installed in its operable orientation. The passage 20 has an upper end 32 for opening upward to admit sunlight when the skylight is in its installed operable orientation and a lower end 34 for opening in a downward direction in its operable orientation to allow exit of the captured light into a room after its transmission through the passage 20.

The preferred skylight also has at least one and preferably two translucent light diffusing bottom sheets 36 and 38 that extend across and cover the lower end 34 of the light transmission passage 20. The higher, bottom, light diffusing sheet 36 preferably comprises a prismatic light diffuser which is essentially a plastic sheet with a two dimensional array of molded or vacuum-formed prisms shaped to deflect light principally in a direction outward away from the central axis 30. The lower, bottom, light diffusing sheet 38 is preferably a matte texture diffuser for providing additional scattering of the exiting light to uniformly illuminate objects surrounding the area beneath the skylight. The lower bottom sheet 38 is domed which provides several advantages. The dome configuration creates a substantial trapped air space between the domed lower bottom sheet 38 and the planar higher bottom sheet 36 which adds thermal insulation at the bottom end of the light transmission passage 20. Additionally, the dome configuration creates a greater spatial separation between the two light diffusing sheets 36 and 38 and that separation enhances the diffusing effect of the 36 and 38 resulting in a more uniform and pleasing light distribution in the building interior. Placement of one or more light diffusing sheets across the upper open end of the light transmission passage would reduce the light energy that is transmitted into the interior room below the skylight. The reason is that a diffuser scatters the light in random directions. Some light is scattered backward so the backscattered light is ejected from the skylight. Light that is scattered sideward or downward but at a more nearly horizontal angle than the angle of incidence from the sun will require more reflections before being emitted from the bottom end of the skylight. The additional reflections reduce the light energy that is transmitted to the bottom of the skylight for the reason previously explained.

The upper end 32 of the light transmission passage 20 is also covered with at least one and preferably two translucent, and preferably transparent, sheets. A higher, top cover sheet 40 is domed and is a UV filtering sheet. The UV filter protects the inner sheet 42, the reflective surfaces 22, 24, 26 and 28 and bottom light diffusing sheets 36 and 38 from degradation and yellowing and also protects inhabitants of the room in which the skylight is installed from the health hazards of UV radiation. A lower, planar, top cover sheet 42 also extends across the upper end of the light transmission passage 20 but below the higher, domed cover sheet 40. As an alternative to the planar top cover sheet 42, the lower top cover sheet can be formed as a shallow dome. Although more expensive than a planar sheet, a shallow domed sheet would be more laterally compliant and consequently would allow controlled elastic deformation of the sheet under high temperature conditions, without excessive stresses on the sheet. The space between the two top cover sheets 40 and 42 forms a thermal barrier in the form of an air trap to reduce heat transfer through the light transmission passage 20. This thermal barrier at the top end of the light transmission passage 20 combines with the air trap at the bottom end of the light transmission passage 20 between the two light diffusing sheets 36 and 38 so that, thermally, the skylight is a quad-pane window with three separated trapped air spaces. For a small minority of installations of skylights that embody the present invention it may be desirable to permit passage of and perhaps even maximize UV radiation transmission through the skylight into the room. For example, if the skylight is installed to illuminate a room housing one or more animals that require UV radiation for vitamin D generation, a transparent, non-filtering higher top cover sheet may be substituted for the UV filtering sheet 40. Most preferably in this embodiment, mirrors are used which are made of UV reflective plastic sheet. The inner top cover sheet 42, and the bottom light diffusing sheets 36 and 38 can be eliminated to avoid UV degradation and permit unimpeded transmission of the sunlight into the room.

The reflective surfaces 22, 24, 26 and 28 are formed on relatively thin plastic sheets which are therefore light in weight but also quite flexible and non-rigid. However, the contour and orientation of the reflective surfaces 22, 24, 26 and 28 are important characteristics of the present invention and need to be maintained. A particularly advantageous solution is to insert a rigid, thermally insulating plastic foam, such as a commercially available polyurethane foam, in the gap between each of the reflective surfaces 22, 24, 26 and 28 and the outer casing 10 that surrounds them. Expanding foam of this type is commonly available and has significant adhesive properties, expands tightly into small spaces and cures to a rigid mass. Consequently, the foam adheres to both the interior surface of the outer casing 10 and the exterior sides of the reflective surfaces 22, 24, 26 and 28 to bond them together as a rigid, unitary body. This foam not only insulates against the conduction of heat between the casing 10 and the reflective surfaces, but also forms an airtight seal to prevent air leaks. As a result, interposing the foam insulation between the outer casing and the reflective surfaces holds the reflective surfaces in their desired curvature and orientation, thermally insulates the skylight, stiffens the assembled casing and reflective surfaces into a rigid body all while maintaining the light weight of the skylight. Furthermore, as will be described below and can be seen in the drawings, some or all of the reflective surfaces preferably have a parabolic curvature and these parabolic surfaces are oriented so that the gap between the casing 10 and the reflective surfaces 22, 24, 26 and 28 becomes wider as the gap progresses upward. The result is that the interposed foam is thicker adjacent the skylight curb which is above the flange 12 and protrudes from the roof where it is exposed to the weather and thermal insulation is most needed.

Mirror Curvature

At least two of the reflective surfaces 22, 24, 26 and 28 that surround and define the boundaries of the light transmission passage though the skylight are formed on curved mirrors. These mirrors can be fabricated of metal, plastic, glass or other mirror materials and desirably have a high proportion of specular reflection. The most preferred minors are composed of acrylic (PMMA) with an aluminum reflective layer because they are highly specularly reflective, lightweight and are relatively easy to form into the desired curvature and configuration.

The skylight of the invention has centrally facing, curved mirror reflective surfaces on opposite sides of the light transmission passage. The curvature of both reflective surfaces are smoothly continuous. Referring to FIG. 11, the curved reflective surface 26 has a slope, y/x, that becomes progressively greater, with respect to a plane 46 that is perpendicular to the axis 30, as the surface progresses from the upper end 48 to the lower end 50 of the reflective surface 26. In most installations, the plane 46 is orientated horizontally. The curved minor reflective surface 26 is also curved inward toward the axis at its upper end 48. The opposite reflective surface 22 has the same curvature properties and the reflective surfaces 22 and 26 are symmetrically positioned on opposite sides of the axis. The progressively increasing slope is illustrated by the slopes of the tangents 52 and 54. The tangent 52 is tangent to the curved reflective surface 26 at a relatively higher point 56 and has a slope $y_1/x_1$. The tangent 54 is tangent to the curved reflective surface 26 at a relatively lower point 58 and has a slope $y_2/x_2$. As can be seen in FIG. 11, the slope $y_2/x_2$ is greater than the slope $y_1/x_1$.

Preferably, the curved reflective surfaces 22 and 26 are parabolic surfaces. It is also preferable that a tangent, for example the tangent 60, to each curved reflective surface 22 and 26 at their lower ends is parallel to the axis 30. The reason is that an extension of such a reflective surface beyond the point where a tangent is vertical would reflect light that, in the absence of such an extension, would be directed into the room below. Therefore a reflection of such light would needlessly reduce the light entering the room below.

Most preferred is that the curved reflective surfaces 22 and 26 have a curvature and are juxtaposed or positioned to form an inverted compound parabolic concentrator. The details of the construction of a compound parabolic concentrator (CPC) are well know in the art. CPCs are used in the prior art for concentrating sunlight on solar energy converting devices for solar heating and electrical power generation, such as photovoltaic cells. In such prior art applications, the larger aperture of the CPC is oriented upward to capture incoming sunlight. In that orientation, the reflective surfaces of the CPC reflect that sunlight to the smaller aperture where the solar energy converting device is located. However, with the skylight of the present invention, the CPC is inverted from its prior art orientation. With the invention, as can be seen in the drawings, the smaller aperture of the CPC is oriented upward to capture incoming light and the larger aperture of the CPC is oriented downward. The result is that, with the invention, the captured sunlight enters the smaller aperture and exits the larger aperture.

This orientation may seem counterproductive because the purpose of a skylight is to capture as much sunlight as possible within the dimensional footprint of the skylight. Positioning the smaller aperture of the CPC at the upper end of the light transmission passage would seem to admit less sunlight through the upper opening than would be admitted into the larger aperture. In fact that is true especially for a high altitude sun and particularly when the sun is at an altitude of 90°. However, the sun is at a high altitude for only brief periods of time during the year and, when it is, there is maximum sunlight transmitted directly through the skylight and little or no need for reflection. In fact when the sun is at any relatively high altitude, the sunlight transmitted directly through the skylight is abundant and some reduction may be desirable. It is when the sun is at a relatively low altitude in the morning and evening that enhancement of the amount of captured sunlight is most desirable. That is the time when the advantage of the invention in capturing low altitude sunlight far outweighs any possible disadvantage during the time of a high sun altitude.

Mathematical analyses for designing a CPC are available in the prior art, including on the internet, and therefore no analysis is given here. From the CPC analyses, it is clear that only two parameters are needed to fully specify the complete geometry of a fully developed CPC. As described in the prior art, a CPC has two parabolic surfaces, each of which intersects the focus of the other. In a fully developed CPC, the parabolic surfaces extend from the point (50 in FIG. 11) where a tangent to the parabolic surface is parallel to the axis (30 in FIG. 11) of the CPC to a point (48 in FIG. 11) that is the focus of the other parabolic surface. With the present invention, a fully developed CPC is preferred but truncated reflective surfaces can be used, although they become less effective as truncation is increased.

The two parameters that fully specify the complete geometry of a fully developed CPC are its acceptance angle θ (shown in FIG. 12) and the distance S across its smaller aperture. Because mirrors of the present invention preferably have a prior art CPC configuration but are inverted from their prior art orientation, further description and clarification of the design parameters is desirable. The general concept of an acceptance angle is that it defines an arcuate range within which rays of light entering a solar reflector are accepted into the solar reflector and passed directly through or reflected through the light exit of the solar reflector. Referring to FIG. 12, line 62 extends from the lower end 50 of the reflective surface 26 through the upper end 48B of the reflective surface 22 and is at the acceptance altitude. Similarly, line 64 extends from the lower end 50B of the reflective surface 222 through the upper end 48 of the reflective surface 26 and is at the acceptance altitude in the opposite direction. The acceptance angle for a solar reflector is measured from the axis of the reflector. If the CPC defined by reflective surfaces 22 and 26 were used in the prior art orientation, its acceptance angle would be the angle θ between the axis 30 and the line 62 and also the equal angle θ between the axis 30 and the line 64. Because the invention uses a CPC in an inverted orientation, light does not enter within the arc of 2×θ shown on the drawing. Nonetheless, this prior art acceptance angle θ is the parameter that is used to calculate the geometrical path of the preferred curved mirror surfaces used in the present invention. The preferred optimum acceptance angle θ design range for embodiments of the invention is 60° to 65°. Of course, as with truncation, embodiments of the invention can vary from that optimum but would give diminished results. For example, acceptance angles in the range of 55° to 70° degrees would give good but not optimum results and acceptance angles in the range of 40° to 85° degrees give some advantageous results. Smaller acceptance angles (less than 60 degrees) produce more collimation and a smaller upper end 32 aperture for a given sized hole in the roof (such skylights are typically installed in buildings through the roof from above) which diminishes total light capture, while larger acceptance angles require more light reflections off the reflective sidewalls, diminishing the optical efficiency. The optimum design gets most of the low angle light to the bottom diffuser 36 in one reflection while maximizing the size of the upper aperture 32, and hence is 60-65 degrees. However some installations may benefit from more collimation (smaller acceptance angle) for example if a straight extension is needed as in FIG. 17. Larger acceptance angles (>65 degrees) produce straighter sides, with a larger upper end 32 aperture, but at the cost of reduced optical efficiency at low sun angles, especially at sunrise and sunset. The designer of a skylight embodying the invention can increase or decrease the distance S in order to make a skylight with a larger or smaller footprint or light transmission passage. However, increasing the distance S also increases the height of the reflective surfaces and therefore of the skylight if the CPC is fully developed and an acceptance angle of 60° is maintained.

FIG. 12 illustrates the effectiveness of the present invention. Parallel solar rays 66 and 68 from a moderate altitude sun are incident upon the reflective surface 26. However, because of the curvature characteristic of reflective surfaces of the invention, the ray 66 that is incident at a higher point on the reflective surface 26 is reflected downward at an angle that is closer to vertical than a ray 68 that is incident at a lower point on the reflective surface 26. So it can be seen that, with the invention, parallel solar rays are given a greater downward reflection by the upper portion of the reflective surfaces than by the lower portion. Of course the angle of reflection equals the angle of incidence. Therefore, a sufficiently lower altitude ray 70 will be reflected as reflected ray 70B. It is important, however, that, although reflected ray 70B is no nearer vertical than the previously described rays 66 and 68, it is considerably nearer vertical than it would be if the reflective surfaces were linear or planar and especially if they were vertical. It is also important that all of the rays described so far become directed out of the skylight and into the room after only one reflection. The ray 72, that has nearly the lowest possible angle from an extremely low altitude sun, is incident on the uppermost part of the reflective surface 26. Consequently the ray 72 is incident upon the part of the reflective surface that gives the most vertically downward shift in the reflection path. Although the ray 72 is reflected to the opposite mirror reflective surface 22, it is reflected to a lower point on the reflective surface 22 because of the lesser slope at the uppermost part of the reflective surface 26. Therefore, the ray 72 is able to exit the skylight after only two reflections despite the nearly horizontal angle of the ray 72.

When the sun is below the acceptance altitude, the reflective surface 22 shadows a lower portion of the reflective surface 26. As the sun moves progressively to a lower and lower altitude, the boundary of the shadow moves up and the incident solar rays are progressively confined to a vertically shrinking uppermost portion of the reflective surface 26. With the invention, the vertically shrinking uppermost portion is the portion with the lowest slope and therefore with the greatest ability to reflect incident light along a more downward path. With the invention, as the sun moves to a lower and lower altitude and the area from which solar rays can be reflective becomes progressively smaller, the progressively smaller area is progressively the area more capable of reflecting the light downward at an angle with a greater vertical component. The greater the vertical component of the direction of reflection, the fewer number of reflections that are required for the light to be transmitted through the skylight. Although the above principles have been described in terms of a setting sun, the same principles apply in the reverse direction for a rising sun.

From the above explanation it can be seen that the inverted CPC operates entirely differently than a CPC in its prior art orientation, especially for a low angle sun. The operational acceptance angle $\Phi$ for a CPC used in the orientation of the invention is 90° as illustrated in FIG. 12. In other words, if the CPC of the invention is oriented in its preferred orientation with its axis 30 vertical, its acceptance angle, within which light entering its upper aperture is reflected through its lower aperture, is 90° from its axis 30 to horizontal, represented by line 73. If a CPC were used in a skylight in the prior art orientation (light entering the larger end), all rays entering the CPC beyond the acceptance angle $\theta$ (i.e. from a lower altitude sun) would be rejected from the CPC by being reflected by the reflective surfaces back out through the larger aperture through which they entered.

Planar Mirrors

As well known in the art, the sun rises in the east and sets in the west. In reality the azimuth of the rising sun varies through the year over a range on either side of east. For example in central Ohio, the azimuth of a rising sun varies from approximately 60° in summer to approximately 120° in winter. Consequently, a low altitude sun generates solar rays that have mainly easterly and westerly components of direction. Easterly and westerly directed solar rays are reflected principally by the reflective surfaces on the east and west sides of the light transmission path through the skylight if those reflective surfaces are aligned along or nearly along north south lines (longitudes). Therefore, the reflective surfaces on the easterly and westerly sides of the light transmission path through the skylight should have the contours described above because those contour characteristics are what improves the light capture from a low altitude sun.

In the most inhabited latitudes of the earth, solar rays do not have a significant northerly or southerly component of direction until well after sunrise and continuing only until well before sunset. Therefore, within these populous latitudes, low angle solar rays with a significant northerly or southerly component of direction will rarely if ever be incident upon the skylight. Solar rays with a northerly or southerly component of direction are reflected principally by reflective surfaces on the northern or southern sides of the light transmission passage through the skylight if those reflective surfaces are aligned along or nearly along east-west lines (latitudes). Because the reflective surfaces on the northern and southern sides of the light transmission passage will not see rays from a low angle sun, not much is gained by forming those reflective surfaces with the contour described above. Rays from a high altitude sun are reflected through the skylight with only one reflection because of their large angle of incidence upon the reflective surfaces. Therefore, the reflective surfaces 24 and 28 are preferably a pair of planar mirror surfaces on opposite sides of the passage but positioned orthogonally of the curved reflective surfaces 22 and 26. Most preferably, the planar mirror surfaces 24 and 28 are parallel to each other and to the axis 30. The advantage of having planar reflective surfaces on the north and south sides of the light transmission passage, and particularly planar surfaces that are parallel to the axis, is that planar reflective surfaces do not curve inward at the top of the light transmission passage. Because they do not curve inward, the opening at the top of the light transmission passage can be larger in cross-sectional area allowing entry of more sunlight. This advantage is gained while losing little because there will be little low angle sun with a northerly or southerly component of direction that would benefit from reflective surfaces that have a curvature according to the present invention.

Experiments were conducted with a laser pointer at a 135° azimuth angle on a prototype embodiment of the invention that had its curved mirrors aligned along a simulated north-south alignment. Light that entered at low elevation angles at a 135 degree azimuth took two reflections to reach the bottom opening, whereas the same light at 90 degrees azimuth reaches the bottom opening on one reflection, like a bank shot on a pool table. With a unit having a square light transmission path cross section, as in the preferred embodiment, the installation angle with north will never be worse than 45 degrees from optimum because the installer can rotate it 90°. Interestingly smaller acceptance angle designs are less sensitive to this than large acceptance angle designs. If the cross sectional shape of the light transmission path is rectangular and planar mirrors are used, the E-W sides should be curved and the N-S sides planar.

All Mirror Reflective Surfaces Curved

There are situations in which the above analysis is inapplicable. As one example, some buildings are not built in alignment with latitudes and longitudes. Some may be quite oblique and even have sides at 45° to a latitude and longitude. Consequently, if the building is oblique, or has oblique roof lines, a skylight may be installed with reflective surfaces that are oblique to their latitude and longitude. Furthermore, the principle that low angle sun occurs only with directional components that are principally easterly and westerly is not accurate at far northern and far southern latitudes. Under conditions such as these, the reflections of low angle sunlight may not be principally confined to one pair of reflective surfaces on opposite sides of the light transmission passage.

For these reasons, it is desirable to have the alternative embodiment of the invention illustrated in FIGS. 13 through 15. All four mirrors are constructed with the curvature described above for reflective surfaces 22 and 26. More specifically, mirrors 122 and 126 have interior curved reflective surfaces that are contoured, oriented and arranged as described above on opposite sides of the light transmission passage 120. Additionally, the skylight of FIGS. 13-15 has an orthogonal pair of mirrors 124 and 128 on opposite sides of the passage 120 but positioned orthogonally of the curved reflective surfaces 122 and 126. The orthogonal mirror surfaces 124 and 128 have a curvature like those described above but most preferably have a curvature and are juxtaposed to form an orthogonal inverted compound parabolic concentrator.

ADDITIONAL EMBODIMENTS

The invention is not limited to embodiments which have a square or rectangular cross section in a plane perpendicular to the axis through their light transmission passage. The invention is also not limited to embodiments which have a two-dimensional curvature.

An embodiment of the invention can have mirror reflective surfaces that are on a surface of rotation. A surface of rotation is generated by a line or curve in a plane that is spaced from a central axis in that plane. The 3-dimensional surface is generated by rotating the plane around the axis so that the line or curve traces the 3-dimensional surface. An example is illustrated in FIG. 16 which shows a 3-dimensional mirror 150 with an upper end 152 surrounding an upper opening 154 and having a lower end 156. Preferably the surfaces of the mirror 150 are segment of a paraboloid and most preferably are contoured according to the design of a CPC. The mirror 150 of FIG. 16 has a circular cross section in a plane perpendicular to its axis through its light transmission passage. A surface of rotation is smoothly continuous around its axis but nonetheless has opposite reflective surfaces on diametrically opposite sides. It is not necessary that opposite reflective surfaces be discontinuous or be two separate surfaces that meet at a corner, but they can be.

A mirror embodying the invention can have a cross section in a plane perpendicular to its axis through its light transmission passage that is a polygon, such as a hexagon or an octagon.

In the event that an installation of an embodiment of the invention has a roof that is substantially above the underlying ceiling of a room below the roof, such as a suspended ceiling, a bottom extension of reflective surfaces can be attached below the curved minors. Referring to FIG. 17, a set of mirror reflective surfaces 160 that are like the reflective surfaces illustrated in FIGS. 1-12, have a bottom extension 162 that consists of four planar minors arranged in a vertical orientation parallel to the axis through its light transmission passage.

Figure 18:
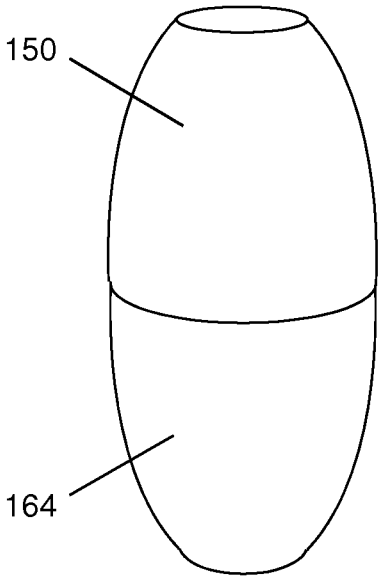
FIG. 18 is a view in perspective of still another alternative embodiment of the invention.
Figure 19:
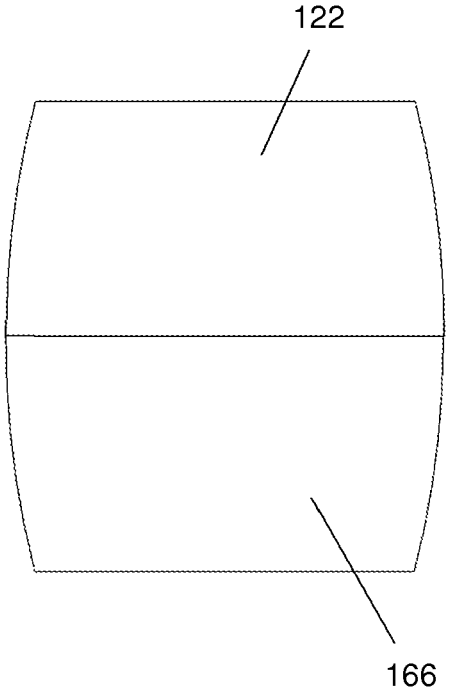
FIG. 19 is a view in perspective of still another alternative embodiment of the invention.

In the event that a designer would like to provide additional sideward scattering of sunlight that is transmitted through the skylight in order to better illuminate the area of the underlying room at places more remote from the skylight, an alternative extension can be mounted below the principal reflective surfaces that are described above for the present invention. For example, FIG. 18 illustrates the mirror 150 with a scattering extension 164. The scattering extension 164 is identical in construction to the mirror 150 but is mounted below the mirror 150 in an orientation that is inverted from the orientation of mirror 150. Although both mirrors 150 and 164 are preferably formed as CPCs, either or both can have any of the other curvatures previously described. FIG. 19 illustrates the same concept but with an upper mirror that is identical to the mirror illustrated in FIGS. 13-15, including mirror 122, with a scattering extension 166 mounted below it. The scattering extension extends the light transmission passage down through the scattering extension. The scattering extension has centrally facing, curved mirror reflective scattering surfaces on opposite sides of the passage. The curved reflective scattering surfaces have a curvature slope that becomes progressively less, with respect to a plane that is perpendicular to the axis of the passage, as the surfaces progress from the upper end to the lower end. The curved mirror scattering surfaces are curved inward toward the axis at the lower end of the scattering extension.

From the above it can be appreciated that embodiments of the invention have a wide acceptance angle and not only are able to capture light essentially 180° from horizon to horizon, but particularly improve the capture efficiency for sun altitudes near the horizon. That is because the curved surfaces, particularly the inverted CPC surfaces, greatly reduce the number of reflections required within the skylight for low angle, small altitude sun.

Additionally, installation of skylights embodying the invention is simple. The lightweight, prefabricated skylight is lowered into a hole in the roof. The flange lays on the roof and is quickly fastened to the roof. All that remains is to install flashing around the skylight and allow the roofer to apply a roof membrane or shingles over the flashing in the conventional manner. No on-site assembly or fabrication of the skylight is required thereby reducing the cost of installation labor. Most preferably and when possible, the skylight is mounted to a roof in an orientation having curved reflective surfaces facing one in an easterly direction and one in a westerly direction and the orthogonal reflective surfaces, whether planar or curved, facing one in a northerly direction and one in a southerly direction.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A skylight with improved light capture and transmission, the skylight, when in an installed operable orientation, having a light transmission passage bounded by reflective surfaces with a central axis along the passage, the passage having an uppermost end for opening upward and a lower end for opening in a downward direction, the skylight comprising:

continuous centrally facing, curved mirror reflective surfaces bounding opposite sides of the entire passage and beginning and extending downward from the upper end of the passage, the curved reflective surfaces having a curvature slope that becomes progressively greater, with respect to a plane that is perpendicular to the axis, as the surfaces progress from the uppermost end to the lower end, the curved mirror surfaces being curved inward toward the axis at their upper end.

2. A skylight in accordance with claim 1 and further comprising a pair of planar mirror surfaces bounding opposite sides of the passage but positioned orthogonally of the curved reflective surfaces.

3. A skylight in accordance with claim 2 wherein the planar mirror surfaces are parallel to each other and the axis.

4. A method for mounting a skylight constructed according to claim 2 and comprising:

mounting the skylight with one of its curved mirror surfaces facing in a direction between 60° and 120° azimuth and the other of its curved mirror surfaces facing in a 180° opposite direction.

5. A skylight in accordance with claim 2 wherein the curved reflective surfaces have identical curvature and are symmetrically positioned on opposite sides of the axis.

6. A skylight in accordance with claim 5 wherein the curved reflective surfaces are parabolic.

7. A skylight in accordance with claim 6 wherein a tangent to each curved reflective surface at the lower end is parallel to the axis.

8. A skylight in accordance with claim 6 wherein the curved reflective surfaces have a curvature and are juxtaposed to form an inverted compound parabolic concentrator.

9. A skylight in accordance with claim 8 and further comprising a scattering extension mounted below the curved mirror reflective surfaces, the scattering extension extending the light transmission passage down through the scattering extension and comprising centrally facing, curved mirror reflective scattering surfaces on opposite sides of the passage, the curved reflective scattering surfaces having a curvature slope that becomes progressively less, with respect to a plane that is perpendicular to the axis of the passage, as the surfaces progress from the upper end to the lower end, the curved mirror scattering surfaces being curved inward toward the axis at the lower end of the scattering extension.

10. A skylight in accordance with claim 8 wherein the inverted compound parabolic concentrator has an acceptance angle in the range of 40° to 85°.

11. A skylight in accordance with claim 10 wherein the inverted compound parabolic concentrator has an acceptance angle in the range of 55° to 70°.

12. A skylight in accordance with claim 11 wherein the inverted compound parabolic concentrator has an acceptance angle in the range of 60° to 65°.

13. A skylight in accordance with claim 1 wherein the curved reflective surfaces have identical curvature and are symmetrically positioned on opposite sides of the axis.

14. A skylight in accordance with claim 13 wherein the curved reflective surfaces are parabolic.

15. A skylight in accordance with claim 14 wherein a tangent to each curved reflective surface at the lower end is parallel to the axis.

16. A skylight in accordance with claim 14 wherein the curved reflective surfaces have a curvature and are juxtaposed to form an inverted compound parabolic concentrator.

17. A skylight in accordance with claim 16 wherein the inverted compound parabolic concentrator has an acceptance angle in the range of 40° to 85°.

18. A skylight in accordance with claim 17 wherein the inverted compound parabolic concentrator has an acceptance angle in the range of 55° to 70°.

19. A skylight in accordance with claim 18 wherein the inverted compound parabolic concentrator has an acceptance angle in the range of 60° to 65°.

20. A skylight in accordance with claim 16 and further comprising a scattering extension mounted below the curved mirror reflective surfaces, the scattering extension extending the light transmission passage down through the scattering extension and comprising centrally facing, curved mirror reflective scattering surfaces on opposite sides of the passage, the curved reflective scattering surfaces having a curvature slope that becomes progressively less, with respect to a plane that is perpendicular to the axis of the passage, as the surfaces progress from the upper end to the lower end, the curved mirror scattering surfaces being curved inward toward the axis at the lower end of the scattering extension.

21. A skylight in accordance with claim 1 and further comprising an orthogonal pair of mirror surfaces on opposite sides of the passage but positioned orthogonally of the previously recited curved reflective surfaces, the orthogonal mirror surfaces also having a curvature slope that becomes progressively greater, with respect to a plane that is perpendicular to the axis, as the surfaces progress from the upper end to the lower end, the curved mirror surfaces being curved inward toward the axis at their upper end.

22. A skylight in accordance with claim 21 wherein the curved reflective surfaces have identical curvature and are symmetrically positioned on opposite sides of the axis.

23. A skylight in accordance with claim 22 wherein the curved reflective surfaces are parabolic.

24. A skylight in accordance with claim 23 wherein a tangent to each curved reflective surface at the lower end is parallel to the axis.

25. A skylight in accordance with claim 23 wherein the curved reflective surfaces have a curvature and are juxtaposed to form an inverted compound parabolic concentrator.

26. A skylight in accordance with claim 25 and further comprising a scattering extension mounted below the curved mirror reflective surfaces, the scattering extension extending the light transmission passage down through the scattering extension and comprising centrally facing, curved mirror reflective scattering surfaces on opposite sides of the passage, the curved reflective scattering surfaces having a curvature slope that becomes progressively less, with respect to a plane that is perpendicular to the axis of the passage, as the surfaces progress from the upper end to the lower end, the curved mirror scattering surfaces being curved inward toward the axis at the lower end of the scattering extension.

27. A skylight in accordance with claim 25 wherein the inverted compound parabolic concentrator has an acceptance angle in the range of 40° to 85°.

28. A skylight in accordance with claim 27 wherein the inverted compound parabolic concentrator has an acceptance angle in the range of 55° to 70°.

29. A skylight in accordance with claim 28 wherein the inverted compound parabolic concentrator has an acceptance angle in the range of 60° to 65°.

30. A skylight in accordance with claim 1 and further comprising an outer casing outwardly surrounding the reflective surfaces and a rigid foam insulation interposed between and adhered to the outer casing and the reflective surfaces.

31. A skylight in accordance with claim 30 wherein a flange extends outward from the casing for attachment of the skylight to a roof.

32. A skylight in accordance with claim 1 and further comprising a transparent, UV filtering sheet across the upper end of the passage.

33. A skylight in accordance with claim 32 and further comprising a second transparent sheet across the upper end of the passage and below the UV filtering sheet.

34. A skylight in accordance with claim 1 and further comprising at least one translucent, light diffusing sheet across the lower end of the passage.

35. A skylight in accordance with claim 34 and further comprising at least two translucent, light diffusing sheets across the lower end of the passage, an upper one of the light diffusing sheets comprising a prismatic light diffuser and a lower one of the light diffusing sheets comprising a matte texture diffuser.

36. A method for capturing sunlight and transmitting the sunlight into a room, the method comprising:

(a) constructing a skylight with an open light transmission passage that is oriented, in its installed operable position, to open at an upper end of the passage in an upward direction and at the opposite end of the passage in a downward direction, the skylight constructed to have continuous curved reflective surfaces bounding opposite sides of the entire passage and beginning and extending downward from the upper end of the passage, the curved reflective surfaces being progressively curved mirror surfaces that progress in a downward direction with a curvature slope that becomes progressively greater from an uppermost end of the reflective surfaces to a lower end of the reflective surfaces, the skylight also constructed to have a pair of planar mirror surfaces on opposite sides of the passage and positioned orthogonally of the curved reflective surfaces; and (b) mounting the skylight to a roof in an orientation having the curved reflective surfaces facing one in an easterly direction and one in a westerly direction and the planar mirror surfaces facing one in a northerly direction and one in a southerly direction.

* * * * *